US009182717B2

(12) United States Patent
Nichols et al.

(10) Patent No.: US 9,182,717 B2
(45) Date of Patent: Nov. 10, 2015

(54) APPARATUS AND METHOD FOR DESTROYING AN ENCODER WHEEL

(71) Applicant: Static Control Components, Inc., Sanford, NC (US)

(72) Inventors: Christopher E. Nichols, Pittsboro, NC (US); David Dale Bascome, Jr., Fayetteville, NC (US); David G. Thompson, Pittsboro, NC (US); Donald R. Huck, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 13/940,980

(22) Filed: Jul. 12, 2013

(65) Prior Publication Data

US 2013/0302043 A1 Nov. 14, 2013

Related U.S. Application Data

(62) Division of application No. 13/020,539, filed on Feb. 3, 2011, now abandoned.

(51) Int. Cl.
*G03G 15/00* (2006.01)
*G03G 15/08* (2006.01)

(52) U.S. Cl.
CPC ..... *G03G 15/50* (2013.01); *G03G 15/0856* (2013.01); *G03G 15/0858* (2013.01); *G03G 15/0894* (2013.01)

(58) Field of Classification Search
USPC ..... 399/12; 396/6
See application file for complete search history.

(56) References Cited

U.S. PATENT DOCUMENTS

| | | | | | |
|---|---|---|---|---|---|
| 5,235,366 | A | * | 8/1993 | Kucmerowski | 396/387 |
| 5,634,169 | A | * | 5/1997 | Barry et al. | 399/12 |
| 5,666,561 | A | * | 9/1997 | Stephenson, III | 396/6 |
| 5,708,855 | A | * | 1/1998 | Teremy | 396/6 |
| 5,763,970 | A | | 6/1998 | Dunning | |
| 5,995,774 | A | * | 11/1999 | Applegate et al. | 399/27 |
| 6,100,601 | A | | 8/2000 | Baker | |
| 6,169,860 | B1 | | 1/2001 | Curry | |
| 6,295,422 | B1 | | 9/2001 | Curry | |
| 6,397,015 | B2 | | 5/2002 | Curry | |
| 6,658,219 | B1 | * | 12/2003 | Ito et al. | 399/27 |
| 6,718,147 | B1 | | 4/2004 | Carter | |
| 7,126,107 | B2 | | 10/2006 | Ahne | |

FOREIGN PATENT DOCUMENTS

| | | | | |
|---|---|---|---|---|
| JP | 02091669 | A | * | 3/1990 |
| JP | 2008203677 | A | * | 9/2008 |

* cited by examiner

*Primary Examiner* — David Gray
*Assistant Examiner* — Tyler Hardman

(57) ABSTRACT

Image recording devices, such as electrophotographic devices, laser printers, copiers, and fax machines, often have a cartridge that utilizes an encoder wheel assembly in addition to or instead of a chip for determining toner load. It may be desirable to alter the encoder wheel or part of the cartridge, either by the printer or the cartridge, to permit a deliberate end of life function situation that requires the replacement of the cartridge, encoder wheel, or encoder wheel assembly components. This thereby controls the remanufacture or replacement of the toner cartridge in a way that is desirable to the manufacturer and prevents unauthorized refilling of the cartridge.

4 Claims, 22 Drawing Sheets

LASER DAMAGES WHEEL

FUSE AGITATOR ONTO AXLE

APPARATUS AND METHOD FOR DESTROYING AN ENCODER WHEEL

BACKGROUND

Many electrophotographic output devices (e.g., laser printers, copiers, fax machines etc.) have traditionally required information about the print cartridge to be available to the output device such that the control of the machine can be altered to yield the best print quality and longest cartridge life.

Literature suggests several methods for detecting toner level in a laser printer. Most of these methods detect a low toner condition or whether toner is above or below a fixed level. Few methods or apparatus effectively measure the amount of unused toner remaining. As an example, some printers currently employ an optical technique to detect a low toner condition. This method attempts to pass a beam of light through a section of the toner reservoir onto a photo sensor. Toner blocks the beam until its level drops below a preset height.

Another common method measures the effect of toner on a rotating agitator or toner paddle which stirs and moves the toner over a sill to present it to a toner adder roller, then developer roller and ultimately the OPC drum. The paddle's axis of rotation is horizontal. As it proceeds through its full 360 degree rotation the paddle enters and exits the toner supply. Between the point where the paddle contacts the toner surface and the point where it exits the toner, the toner resists the motion of the paddle and produces a torque load on the paddle shaft. Low toner is detected by either 1) detecting if the torque load caused by the presence of toner is below a given threshold at a fixed paddle location or 2) detecting if the surface of the toner is below a fixed height.

In either method there is a driving member supplying drive torque to a driven member (the paddle) which experiences a load torque when contacting the toner. Some degree of freedom exists for these two members to rotate independently of each other in a carefully defined manner. For the first method 1) above, with no load applied to the paddle, both members rotate together. However, when loaded the paddle lags the driving member by an angular distance that increases with increasing load. In the second method 2), the unloaded paddle leads the rotation of the driving member, under the force of a spring or gravity. When loaded (i.e., the paddle contacts the surface of the toner), the driving and driven members come back into alignment and rotate together. By measuring the relative rotational displacement of the driving and driven members (a.k.a. phase difference) at an appropriate place in the paddle's rotation, the presence of toner can be sensed.

In the prior art, this relative displacement is sensed by measuring the phase difference of two disks. The first disk is rigidly attached to a shaft that provides the driving torque for the paddle. The second disk is rigidly attached to the shaft of the paddle and in proximity to the first disk. Usually both disks have matching notches or slots in them. The alignment of the slots or notches, that is how much they overlap, indicates the phase relationship of the disks and therefore the phase of the driving and driven members.

In many cartridges, a disk or an encoder wheel is provided (typically located on the side of the cartridge) whose function is to provide intelligence to the printer regarding the amount of new toner remaining in the toner hopper. This feature, along with the printed circuit board or "chip", provides the printer and operator with vital information regarding the cartridge life, page yield, and other related data.

The chip is typically replaced every time a cartridge is remanufactured. The encoder wheel, however, is currently reusable. It is a mechanical device rotated by a gear drive that transfers information by its speed of rotation and special features on the wheel that are scanned as it rotates. The scanned information is used to determine the amount of toner remaining in the toner hopper and ultimately the life of the cartridge.

It may be desirable to limit the life of the encoder wheel and thereby restrict reuse of the cartridge. Disabling the encoder wheel prevents unauthorized reuse of the cartridge or will prevent a cartridge from being reused beyond its expected lifetime. The encoder wheel may be permanently disabled or temporarily disabled.

SUMMARY

The present system and method provides for the destruction of an encoder that is attached to a cartridge. The encoder wheel may be destroyed or disabled gradually or at the end of the cartridge's life.

The encoder wheel may be permanently destroyed, such as by cutting, or may be temporarily disabled. This system and method will prevent unauthorized refilling of a cartridge.

These and other features and objects of the invention will be more fully understood from the following detailed description of the embodiments, which should be read in light of the accompanying drawings.

In this regard, before explaining at least one embodiment of the invention in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be used as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and form a part of the specification, illustrate embodiments of the present invention and, together with the description, serve to explain the principles of the invention.

DETAILED DESCRIPTION OF THE DRAWINGS

Figure 1:
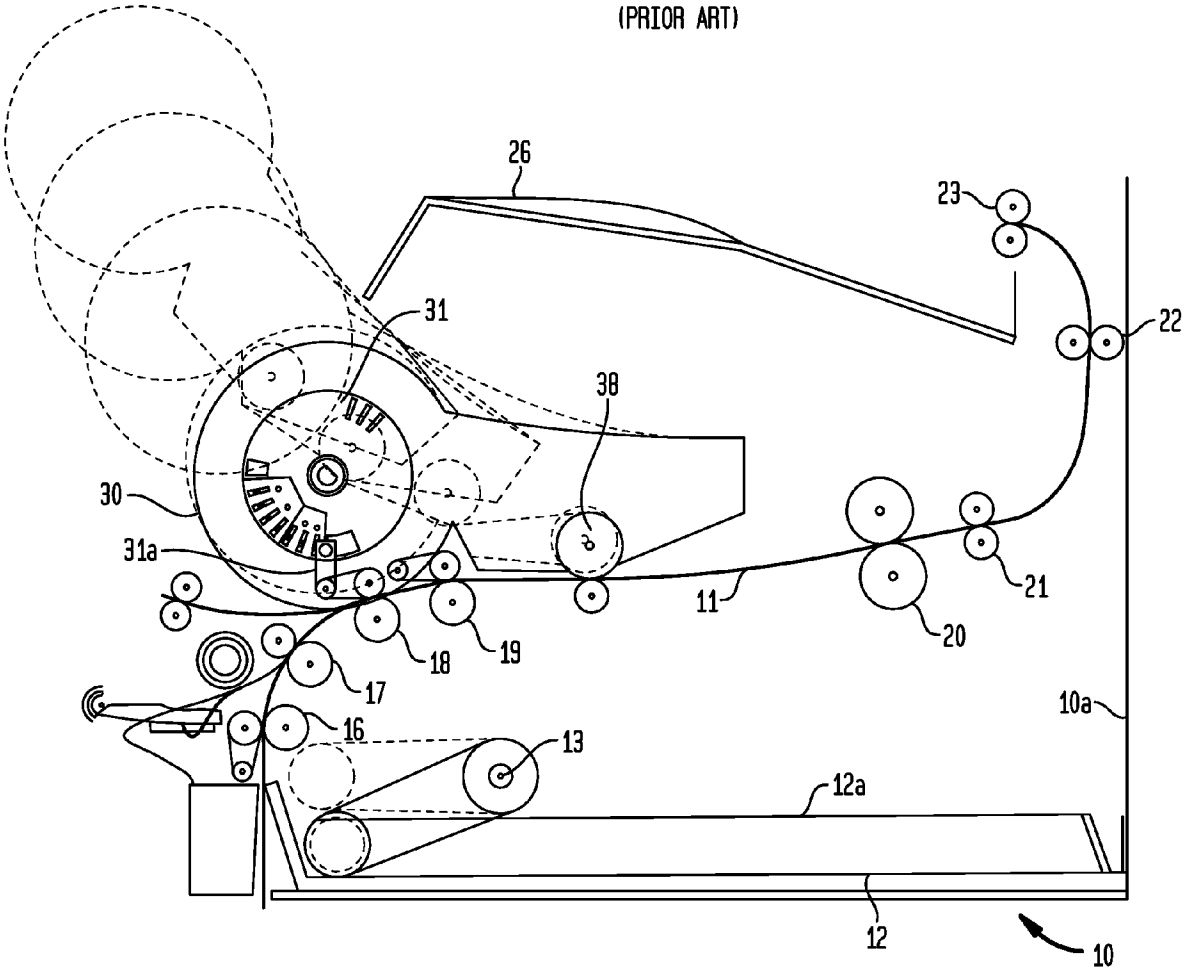
FIG. 1 (PRIOR ART)
FIG. 1 is a schematic side elevational view illustrating the paper path in a typical electrophotographic machine, in the illustrated instance a printer, and showing a replacement supply EP cartridge, constructed in accordance with the present invention, and the manner of insertion thereof into the machine.

In describing an embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

FIG. 1 shows a schematic side elevational view of the printer 10, illustrating the print receiving media path 11 and including a replacement supply electrophotographic (EP) cartridge 30, constructed in accordance with the present invention. As illustrated, the machine 10 includes a casing or housing 10*a* which supports at least one media supply tray 12, which by way of a picker arm 13, feeds cut sheets of print receiving media 12*a* (e.g., paper) into the media path 11, past the print engine which forms in the present instance part of the cartridge 30, and through the machine 10. A transport motor drive assembly 15 (FIG. 3) affords the driving action for feeding the media through and between the nips of pinch roller pairs 16-23 into a media receiving output tray 26.

Figure 2:
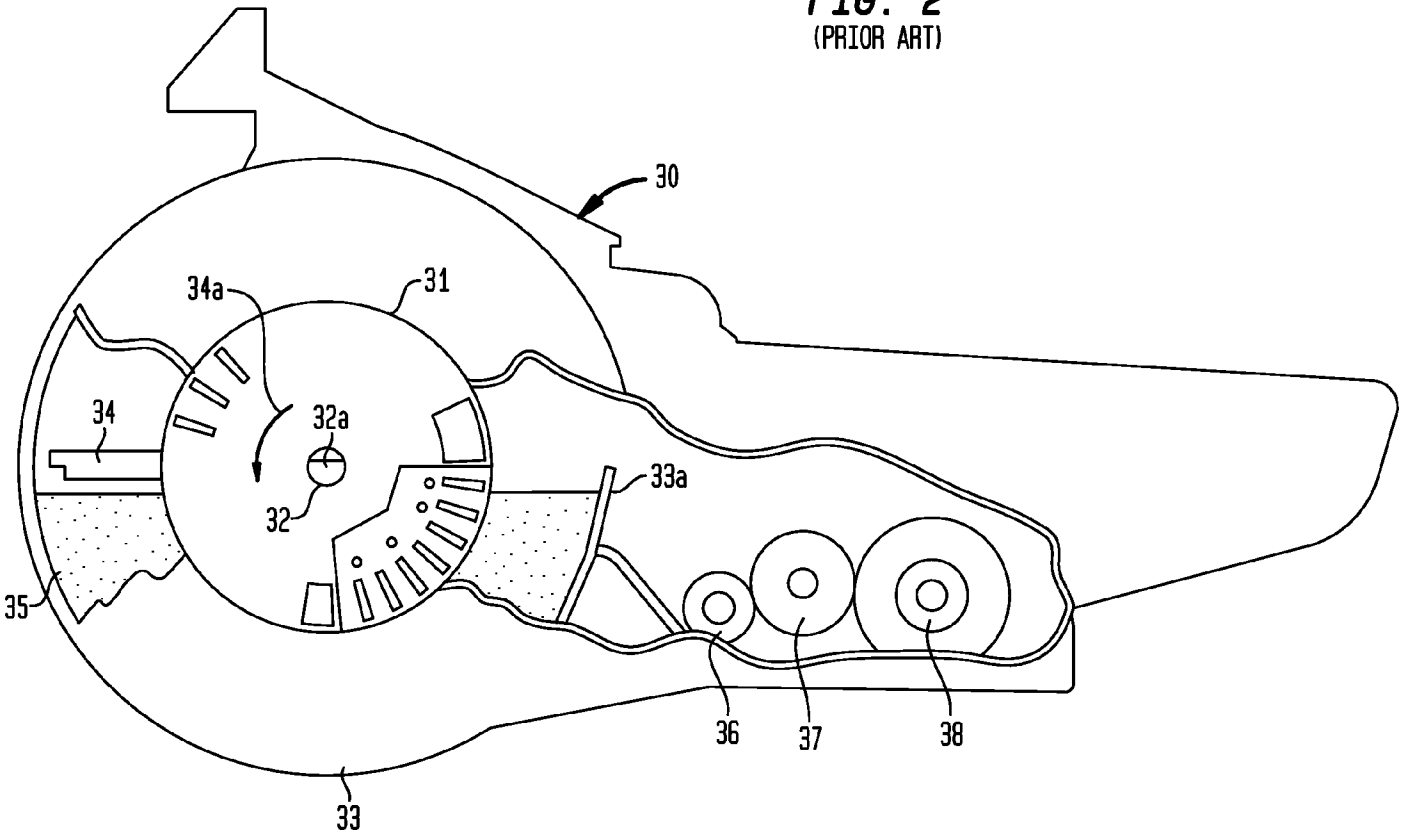
FIG. 2 (PRIOR ART)
FIG. 2 is a fragmentary, enlarged, simplified, side elevational view of the cartridge illustrated in FIG. 1, and removed from the machine of FIG. 1.
Figure 3:
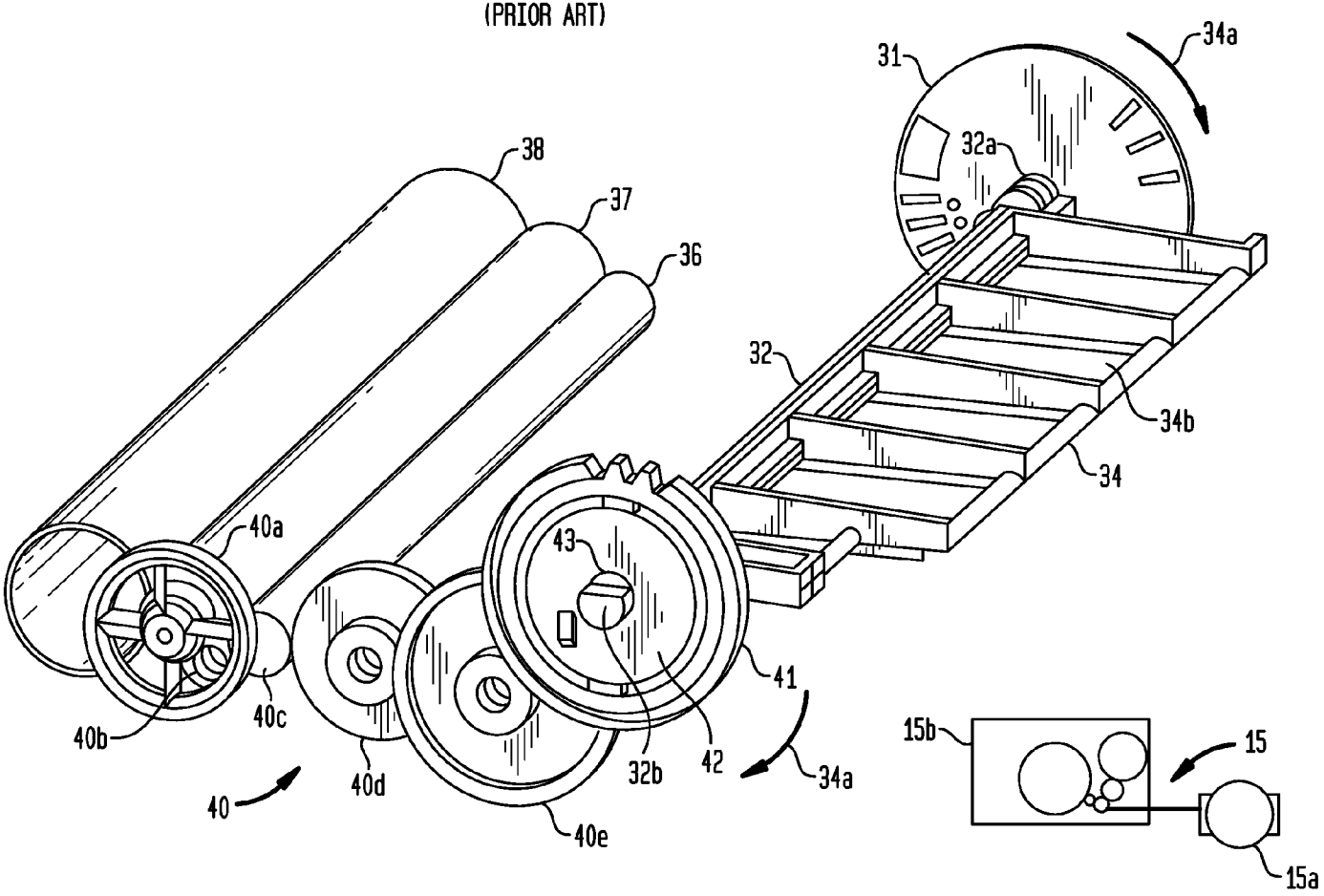
FIG. 3 (PRIOR ART)
FIG. 3 is a fragmentary perspective view of the interior driven parts of the EP cartridge illustrated in FIGS. 1 and 2, including the encoder wheel and its relative position with regard to the drive mechanism for the cartridge interior driven parts.

Referring now to FIGS. 1 & 2, the cartridge 30 includes an encoder wheel 31 adapted for coaction, when the cartridge 30 is nested in its home position within the machine 10, with an encoder wheel sensor or reader 31 a for conveying or transmitting to the machine 10 information concerning cartridge characteristics including continuing data (while the machine is running) concerning the amount of toner remaining within the cartridge and/or preselected cartridge characteristics, such as, cartridge type or size, toner capacity, toner type, photoconductive drum type, etc. To this end, the encoder wheel 31 is mounted, in the illustrated instance on one end 32*a* of a shaft 32, which shaft is coaxially mounted for rotation within a cylindrical toner supply sump 33. Mounted on the shaft 32 for synchronous rotation with the encoder wheel 31, extending radially from the shaft 32 and axially along the sump 33 is a toner agitator or paddle 34. The toner 35 level for a cartridge (depending upon capacity) is generally as shown extending approximately from the 9:00 position and then counter clockwise to the 3:00 position. As the paddle 34 rotates counter clockwise in the direction of the arrow 34*a*, toner tends to be moved over the sill 33*a* of the sump 33. (The paddle 34 is conventionally provided with large openings 34*b*, FIG. 3, to provide lower resistance thereto as it passes through the toner 35.) As best shown in FIGS. 2 & 3, the toner that is moved over the sill 33*a*, is presented to a toner adder roller 36, which interacts in a known manner with a developer roller 37 and then an organic photo conductive (OPC) drum 38 which is in the media path 11 for applying text and graphical information to the print receiving media 12*a* presented thereto in the media path 11.

Referring now to FIG. 3, the motor transport assembly 15 includes a drive motor 15*a*, which is coupled through suitable gearing and drive take-offs 15*b* to provide multiple and differing drive rotation to, for example, the OPC drum 38 and a drive train 40 for the developer roller 37, the toner adder roller 36 and through a variable torque arrangement, to one end 32*b* of the shaft 32. The drive motor 15*a* may be of any convenient type, e.g., a stepping motor or in the preferred embodiment a brushless DC motor. While any of several types of motors may be employed for the drive, including stepping motors, a brushless DC motor is ideal because of the availability of either hall effect or frequency generated feedback pulses which present measurable and finite increments of movement of the motor shaft. The feedback accounts for a predetermined distance measurement, which will be referred to as an increment rather than a 'step' so as not to limit the drive to a stepping motor.

The drive train 40, which in the present instance forms part of the cartridge 30, includes driven gear 40*a*, which is directly coupled to the developer roller 37, and through an idler gear 40*b* is coupled to the toner adder roller 36 by gear 40*c*. Gear 40*c* in turn through suitable reduction gears 40*d* and 40*e* drives final drive gear 41. In a manner more fully explained below with reference to FIGS. 5 & 6, the drive gear 41 is coupled to the end 32*b* of shaft 32 through a variable torque sensitive coupling.

Figure 4:
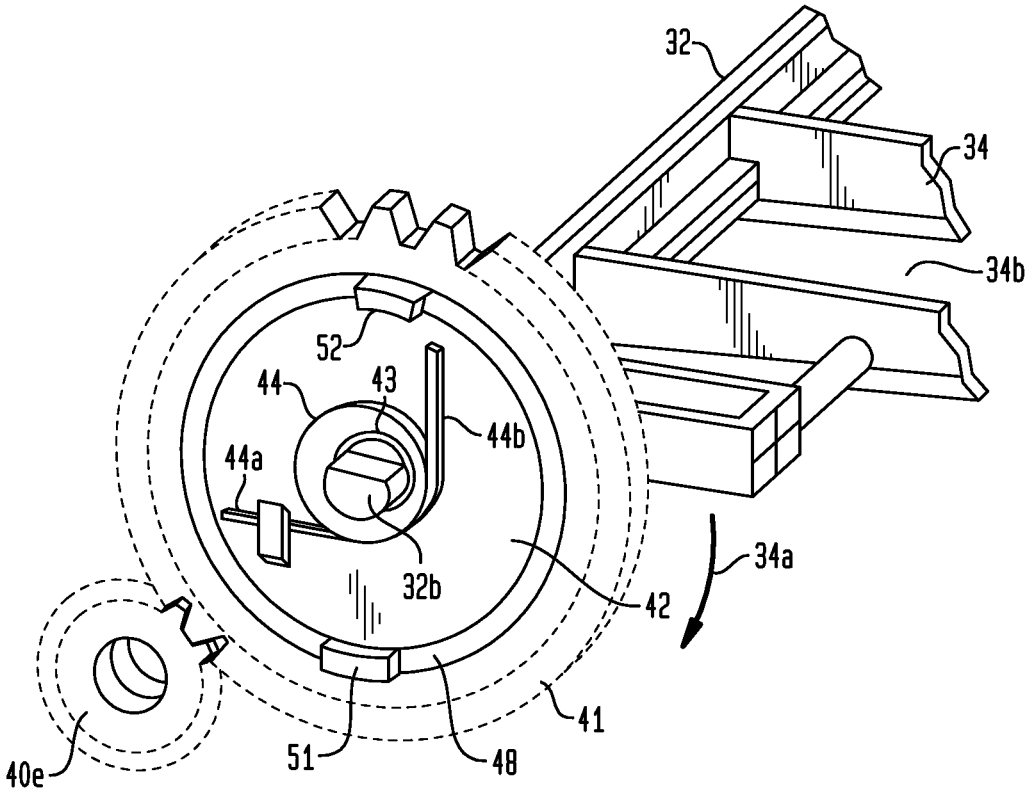
FIG. 4 (PRIOR ART)
FIG. 4 is an enlarged fragmentary perspective view of the agitator/paddle drive for the toner sump, and illustrating a portion of the torque sensitive coupling between the drive gear and the driven shaft for the agitator/paddle.

In FIG. 3, the gear 41 is shown as including an attached web or flange 42 connected to a collar 43 which acts as a bearing permitting, absent restraint, free movement of the gear 41 and its web 42 about the end 32*b* of the shaft 32. Referring now to FIG. 4, the driving half of the variable torque sensitive coupling is mounted on the web 42 of the gear 41. To this end, the driving half of the coupling includes a coiled torsion spring 44, one leg 44*a* of which is secured to the web 42 of the gear 41, the other leg 44*b* of which is free standing.

Figure 5A:
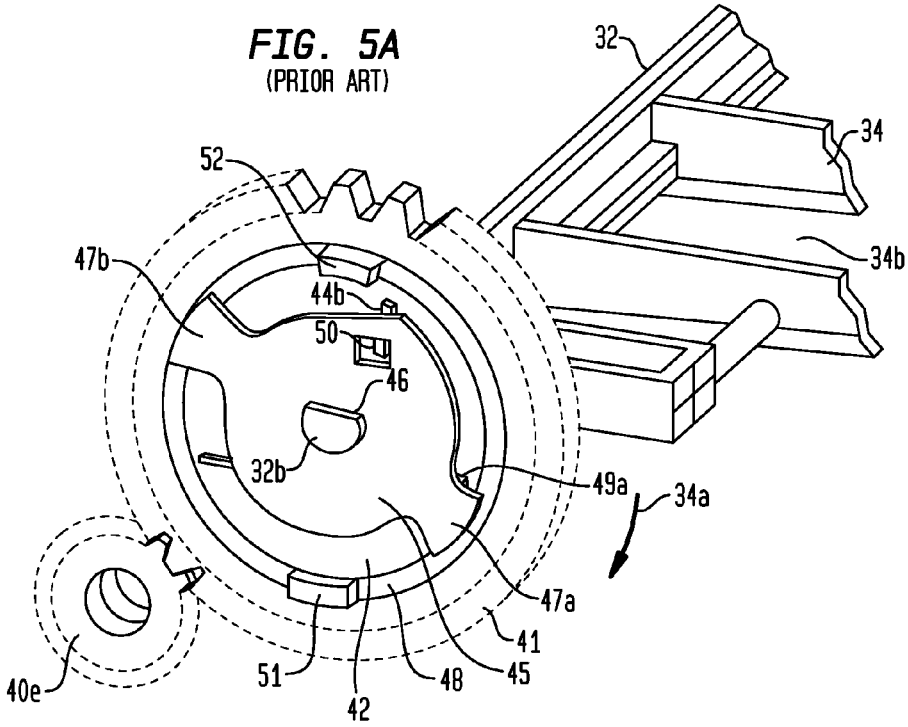
FIG. 5A (PRIOR ART)
FIG. 5A is a fragmentary view similar to FIG. 4, except illustrating another portion of the torque sensitive coupling for coupling the driven shaft for the agitator/paddle, through the coupling to the drive gear.
Figure 5B:
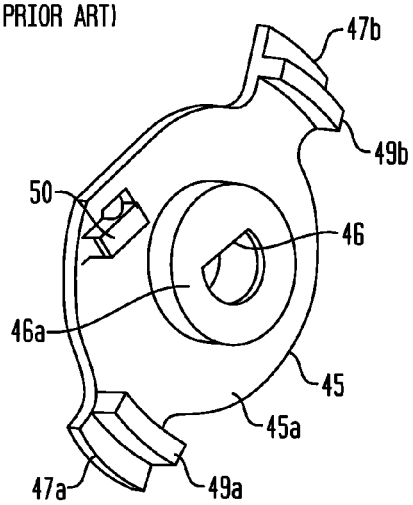
FIG. 5B (PRIOR ART)
FIG. 5B depicts the reverse side of one-half of the torque sensitive coupling, and that portion which connects to the agitator/paddle shaft.

Turning now to FIG. 5A, the other half (driven half) of the coupling is illustrated therein. To this end, an arbor 45, having a keyed central opening 46 dimensioned for receiving the keyed (flat) shaft end 32*b* of the shaft 32, is depicted therein. For ease of understanding, an inset drawing is provided wherein the reverse side of the arbor 45 is shown (see FIG. 5B). The arbor 45 includes radially extending ear portions 47*a*, 47*b*, the extended terminal ends of which overlay the flange 48 associated with the web 42 of the gear 41. The rear face or back surface 45*a* of the arbor 45 (see FIG. 5B) confronting the web 42, includes depending, reinforcing leg portions 49*a*, 49*b*. A collar 46*a* abuts the web 42 of the gear 41 and maintains the remaining portion of the arbor 45 spaced from the web 42 of the gear 41. Also attached to the rear of the back surface 45*a* of the arbor 45 is a clip 50 which grasps the free standing leg 44*b* of the spring 44.

Thus one end 44*a* (FIG. 4) of the spring 44 is connected to the web 42 of the gear 41, while the other end 44*b* of the spring 44 is connected to the arbor 45 which is in turn keyed to the shaft 32 mounted for rotation in and through the sump 33 of the cartridge 30. Therefore the gear 41 is connected to the shaft 32 through the spring 44 and the arbor 45. As the gear 41 rotates, the end 44*b* of the spring presses against the catch 50 in the arbor 45 which tends to rotate causing the paddle 34 on the shaft 32 to rotate. When the paddle first engages the toner 35 in the sump 33, the added resistance causes an increase in torsion and the spring 44 tends to wind up thereby causing the encoder wheel 31 to lag the rotational position of the gear 41. Stops 51 and 52 mounted on the flange 48 prevent over winding or excessive stressing of the spring 44. In instances where the sump 33 is at the full design level of toner 35, the ears 47*a*, 47*b* engage the stops 52 and 51 respectively. The spring 44 therefore allows the paddle shaft 32 to lag relative to the gear 41 and the drive train 40 because of the resistance encountered against the toner 35 as the paddle 34 attempts to move through the sump 33. The more resistance encountered because of toner against the paddle 34, the greater the lag. As shall be described in more detail hereinafter, the difference in distance traveled by the gear 41 (or more often the motor 15*a*) and the encoder wheel 31, as the paddle 34 traverses the sump 33 counter clockwise from the 9:00 position (see FIG. 2) to about the 5:00 position, is a measure of how much toner 35 remains in the sump 33, and therefore how many pages may yet be printed by the printer 10 before the cartridge 30 is low on toner. This measurement technique will be explained more fully with regard to finding the home position of the encoder wheel 31 and reading the wheel.

Figure 6:
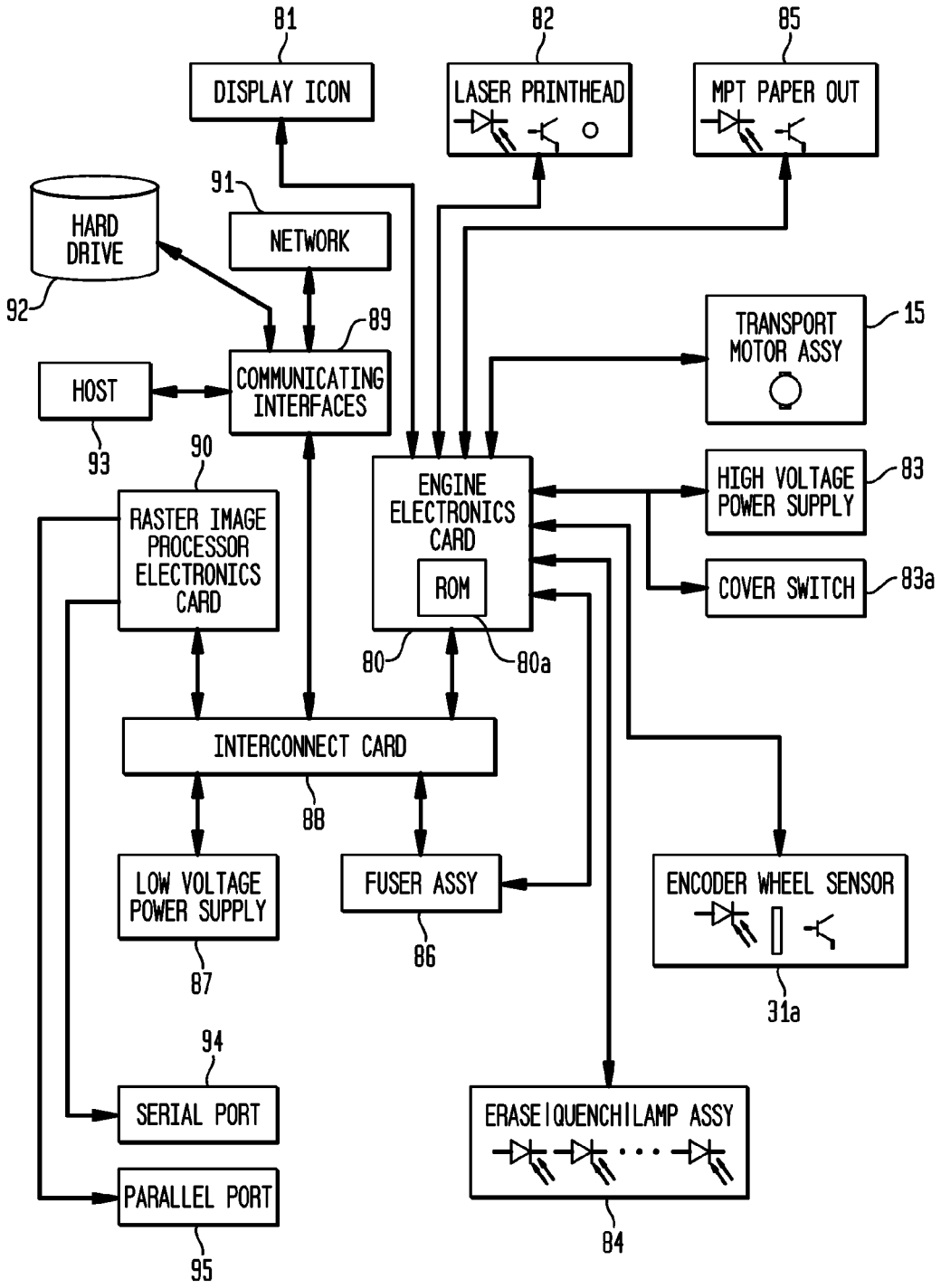
FIG. 6 (PRIOR ART)
FIG. 6 is a simplified electrical diagram for the machine of FIG. 1, and illustrating the principal parts of the electrical circuit.

Turning now to FIG. 6 which is a simplified electrical diagram for the machine 10, illustrating the principal parts of the electrical circuit thereof, the machine employs two processor (micro-processor) carrying boards 80 and 90, respectively labeled "Engine Electronics Card" and "Raster Image Processor Electronics Card" (hereinafter called EEC and RIP respectively). As is conventional with processors, they include memory, I/O and other accouterments associated with small system computers on a board. The EEC 80, as shown in FIG. 6, controls machine functions, generally through programs contained in the ROM 80*a* on the card and in conjunction with its on-board processor. For example, on the machine, the laser printhead 82; the motor transport assembly 15; the high voltage power supply 83 and a cover switch 83*a* which indicates a change of state to the EEC 80 when the cover is opened: the Encoder Wheel Sensor 31 a which reads the code on the encoder wheel 31 informing the EEC 80 of needed cartridge information and giving continuing data concerning the toner supply in the sump 33 of the EP cartridge 30; a display 81 which indicates various machine conditions to the operator, under control of the RIP when the machine is operating but capable of being controlled by the EEC during manufacturing, the display being useful for displaying manufacturing test conditions even when the RIP is not installed. Other functions such as the Erase or quench lamp assembly 84 and the MPT paper-out functions are illustrated as being controlled by the EEC 80. Other shared functions, e.g., the Fuser Assembly 86 and the Low Voltage Power Supply 87 are provided through an interconnect card 88 (which includes bussing and power lines) which permits communication between the RIP 90 and the EEC 80, and other peripherals. The Interconnect card 88 may be connected to other peripherals through a communications interface 89 which is available for connection to a network 91, non-volatile memory 92 (e.g., hard drive), and of course connection to a host 93, e.g., a computer such as a personal computer and the like.

The RIP primarily functions to receive the information to be printed from the network or host and converts the same to a bit map and the like for printing. Although the serial port 94 and the parallel port 95 are illustrated as being separable from the RIP card 90, conventionally they may be positioned on or as part of the card.

Figure 7:
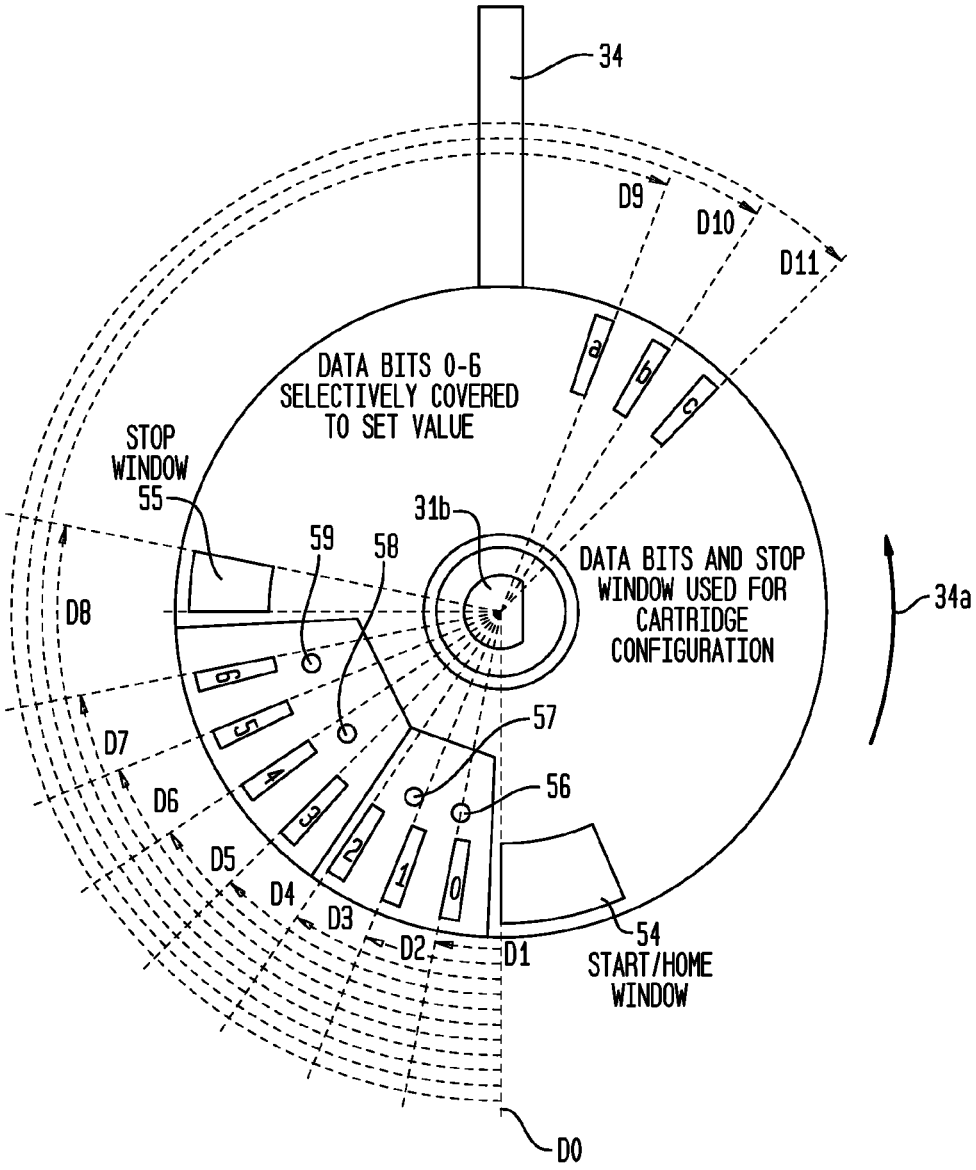
FIG. 7 (PRIOR ART)
FIG. 7 is an enlarged side elevational view of the encoder wheel employed in accordance with the present invention, and viewed from the same side as shown in FIG. 2, and from the opposite side as shown in FIG. 3.

The structure of the encoder wheel 31 is shown in FIG. 7. The encoder wheel 31 is preferably disk shaped and comprises a keyed central opening 31 b for receipt by like shaped end 32*a* of the shaft 32. The wheel includes several slots or windows therein which are positioned preferably with respect to a start datum line labeled D0, for purposes of identification. From a "clock face" view, D0 resides at 6:00, along the trailing edge of a start/home window 54 of the wheel 31. (Note the direction of rotation arrow 34*a*.) The paddle 34 is schematically shown positioned at top-dead-center (TDC) with respect to the wheel 31 (and thus the sump 33). The position of the encoder wheel sensor 31 a, although stationary and attached to the machine, is assumed, for discussion purposes, aligned with D0 in the drawing and positioned substantially as shown schematically in FIG. 1.

Because the paddle 34 is generally out of contact with the toner in the sump, from the 3:00 position to the 9:00 position (counter clockwise rotation as shown by arrow 34*a*), and the shaft velocity may be assumed to be fairly uniform when the paddle moves from at least the 12:00 (TDC) position to the 9:00 position, information concerning the cartridge 30 is preferably encoded on the wheel between 6:00 and approximately the 9:00 position. To this end, the wheel 31 is provided with radially extending, equally spaced apart, slots or windows 0-6, the trailing edges of which are located with respect to D0 and labeled D1-D7 respectively. Each of the slots 0-6 represents an information or data bit position which may be selectively covered as by one or more decals. Suffice at this point that a plurality of apertures 56-59 are located along an arc with the same radius but adjacent the data slots or windows 0-6. Note that the spacing between apertures 56 and 57 is less than the spacing between apertures 58 and 59.

The coded data represented by combinations of covered, not-covered slots 0-6 indicate to the EEC 80 necessary information as to the EP cartridge initial capacity, toner type, qualified or unqualified as an OEM type cartridge, or such other information that is either desirable or necessary for correct machine operation. Adjacent slot 6 is a stop window 55 which has a width equal to the distance between the trailing edges of adjacent slots or windows, e.g., D1=(D2-D1, =D3-D2 etc.)=the width of window 55. Note that the stop window 55 is also spaced from the trailing edge of slot 6 a distance equal to the stop window width 55. That is, the distance D8-D7=twice the window 55 width while the window width of window 55 is greater than the width of the slots 0-6.

Figure 8:
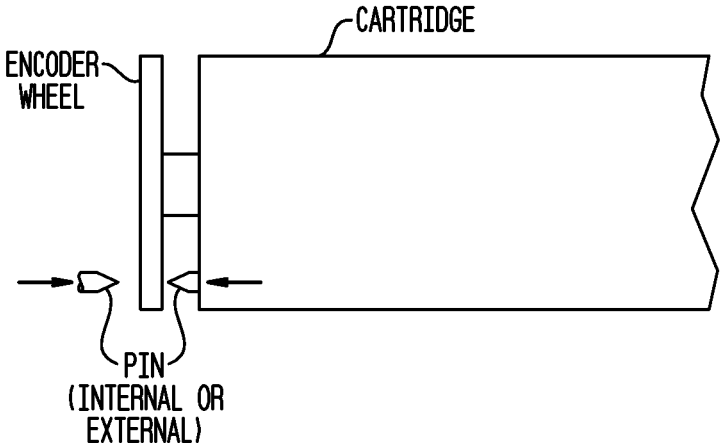
FIG. 8 illustrates an embodiment of the invention where a pin damages the encoder wheel.

FIG. 8 illustrates a first embodiment, the printer or cartridge is equipped with a device that cuts or damages the encoder wheel. The device is operated to damage the encoder wheel after a set number of pages has been printed or after the encoder wheel has sensed and reports a toner low or toner out condition. The damage is caused by a sharp device, such as a pin, that is engaged at the end of life to scratch the encoder wheel as it rotates.

Figure 9:
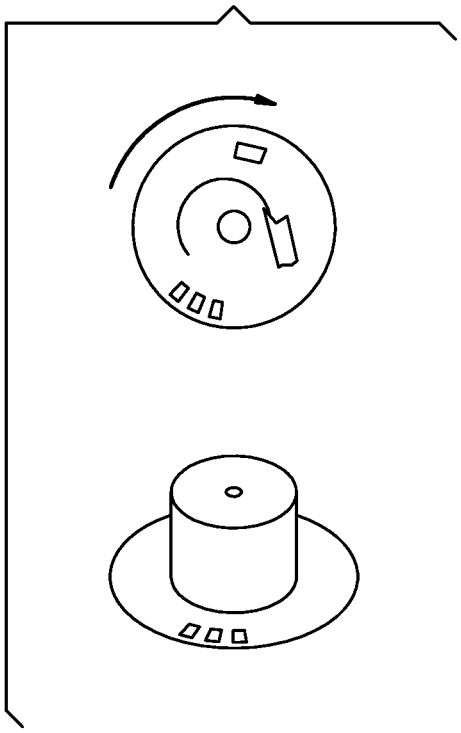
FIG. 9 illustrates an embodiment where a blade damages the encoder wheel.

Alternatively, the encoder wheel may be disabled by usage of a small cutting blade or scissors. At or near the end of life, this blade would circumscribe a circular cut through a section of the wheel, causing an outer ring of the wheel to fall away towards the cartridge as shown in FIG. 9. This renders the encoder wheel inoperable and forces an operator to replace the encoder wheel before the cartridge could be made functional again.

Figure 10:
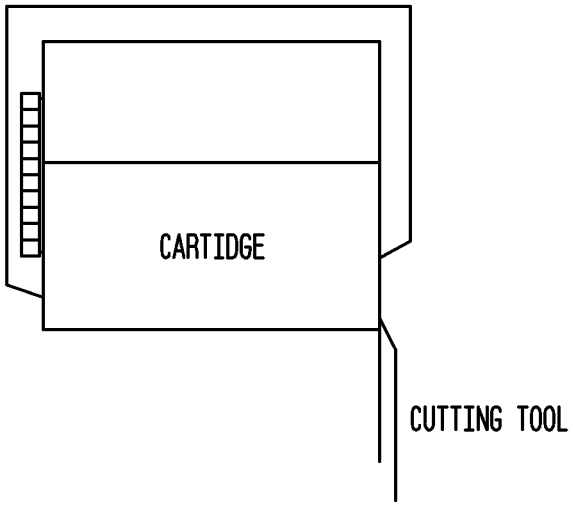
FIG. 10 illustrates an embodiment where the encoder wheel is cut.

FIG. 10 illustrates another embodiment. At the end of the cartridge life, a cutting mechanism could emerge in the printer and cut through the base of the encoder wheel and/or its axle, thereby removing the encoder wheel from the cartridge and preventing remanufacture without interference to the sensing system.

Figure 11:
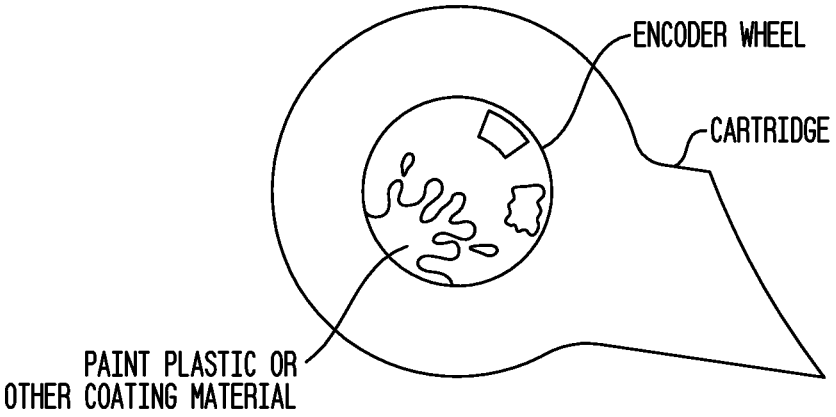
FIG. 11 illustrates an embodiment where a material is used to coat a portion or all of the encoder wheel.

FIG. 11 illustrates another embodiment. In this embodiment, a paint, foreign material, and/or a coating is added to the encoder wheel at or near the end of the cartridge's life to restrict the capability of the printer to be able to read the rotation of the encoder wheel. The foreign material prevents the encoder from being read by a reader. The material used may permanently destroy the encoder or be a material that is removable to allow the encoder to be reused at a cost. Additionally, the removable material may enable the encoder to be reused a limited number of times preventing a cartridge from being reused too many times.

Figure 12:
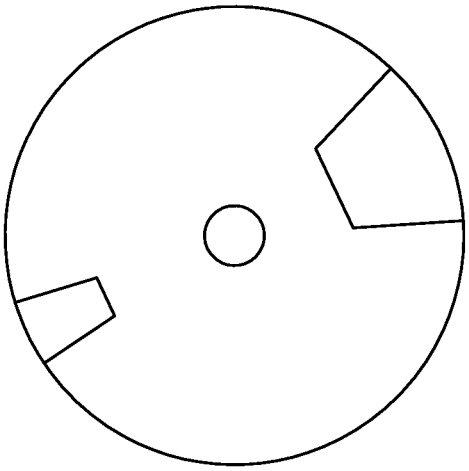
FIG. 12 illustrates an embodiment where toner is used to coat a portion of the encoder wheel.

FIG. 12 illustrates another embodiment. In this embodiment a hopper cap rests near the bottom surface of the encoder wheel. The hopper cap is ventilated, but if the protective foam fails, then toner will leak from the cap onto the encoder wheel. Thus, the laser cannot read the mirror surface if the mirror is coated in toner. The protective foam can be made of a material that fails after a predetermined number of print operations. Alternatively, the foam may be destroyed by secondary means such as a laser, a heater, a puncturing device (i.e. a pin), or any other known device.

In another embodiment, the material and/or the design of the encoder or wheel or the drive wheel is changed to allow for the manufacturer to selectively limit the life of the component(s). The material can be designed to deteriorate or wear after a given number of rotations. Alternatively, a mechanism is designed so that the printer applies a force to the wheel to stop its rotation or cease its ability to function. This embodiment enables the encoder wheel to be automatically disabled after a predetermined lifetime without having to provide another element.

Figure 13:
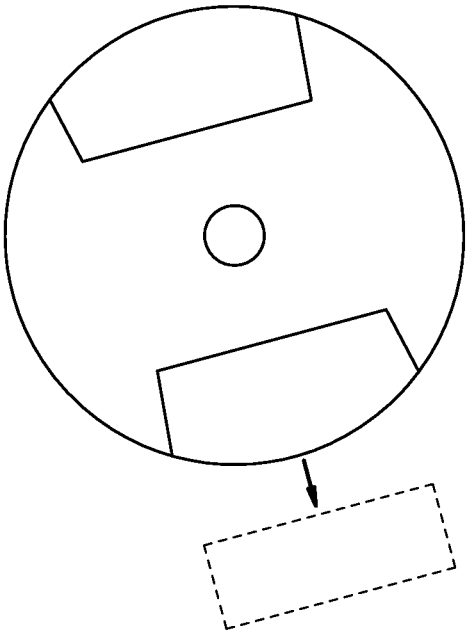
FIG. 13 illustrates an embodiment for disabling an encoder wheel having a reflective material adhered on a surface of the encoder wheel.

On some cartridge models the encoder wheel has a reflective material adhered to a surface and sensing is done by reading the piece of reflective material. FIG. 13 illustrates an embodiment for disabling an encoder wheel in this type of cartridge model. In this embodiment, at predetermined time, heat is generated from the fusing unit or another heat source causing the adhesive to lose its bonding ability and allow the reflective material to separate from encoder wheel. This would disable the printer's ability to sense the amount of toner remaining. The predetermined time may be based an amount of toner remaining in the cartridge, the amount of toner used in the cartridge, a number of times the cartridge has been refilled, or any other desired time. Furthermore, an encoder having a reflective material adhered to a surface may be disabled by any of the other methods disclosed herein.

Figure 14:
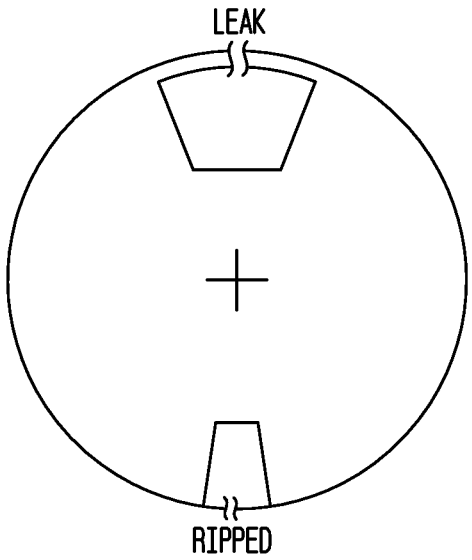
FIG. 14 illustrates an embodiment where an encoder wheel has marked holes near the perimeter of the wheel.

Many encoder wheels have marked holes near the perimeter of the wheel, causing the outer edge to be made of a very thin ring of plastic. FIG. 14 illustrates an embodiment for a printer having this type of encoder wheel. When it is determined to disable the encoder wheel a mechanism damages the thin outer ring, potentially rendering the encoder wheel unreadable by the printer.

Figure 15:
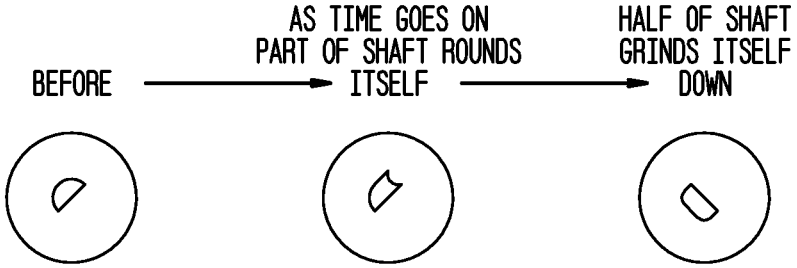
FIG. 15 illustrates an embodiment where the encoder wheel is not fitted exactly on an axle.

In many prior art printers the encoder wheel and the axle that the encoder wheel turns on are both plastic and molded to fit one another exactly. FIG. 15 illustrates an embodiment where the encoder wheel is not fitted exactly on the axle. One or both of the encoder wheel and the axle may be intentionally molded in such a way that the fit is inexact, so that as the assembly turns, the pieces wear against one another throughout the cartridge life. By the end of the cartridge life the encoder wheel and the axle have worn out. This wear prevents the encoder wheel from functioning properly and from being reused if the cartridge is refilled.

Figure 16:
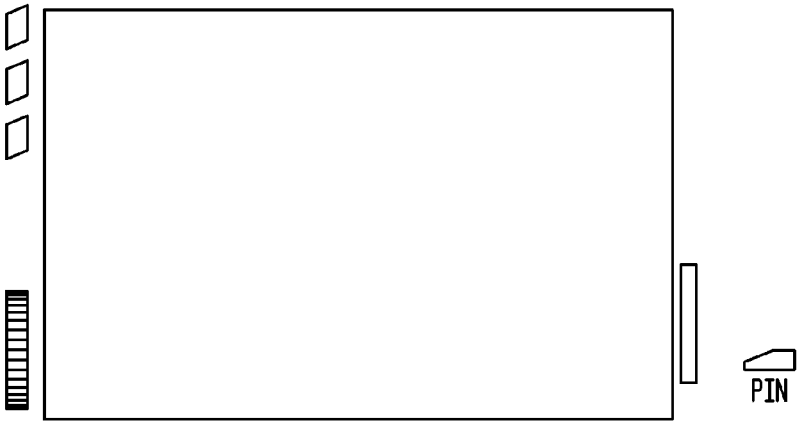
FIG. 16 illustrates an embodiment where a device where a mechanism is inserted to one or more holes on the encoder wheel.

FIG. 16 illustrates an embodiment where a device where a mechanism is inserted to one or more holes on the encoder wheel. When it is determined to disable the encoder wheel, a mechanism is sprung from the printer into one of the holes located in the encoder wheel. This mechanism prevents the encoder wheel from rotating and disables the toner sensing system. The mechanism may be any device that can fit into the one or more holes. For example the mechanism may be a pin, a screw, a nail, or a braking mechanism. Additionally, the mechanism may cause additional parts of the sensing assembly to come to a stop. Furthermore, the mechanism may be designed so that as the encoder wheel attempts to rotate, the mechanism further expands the holes or damages the encoder wheel.

Figure 17:
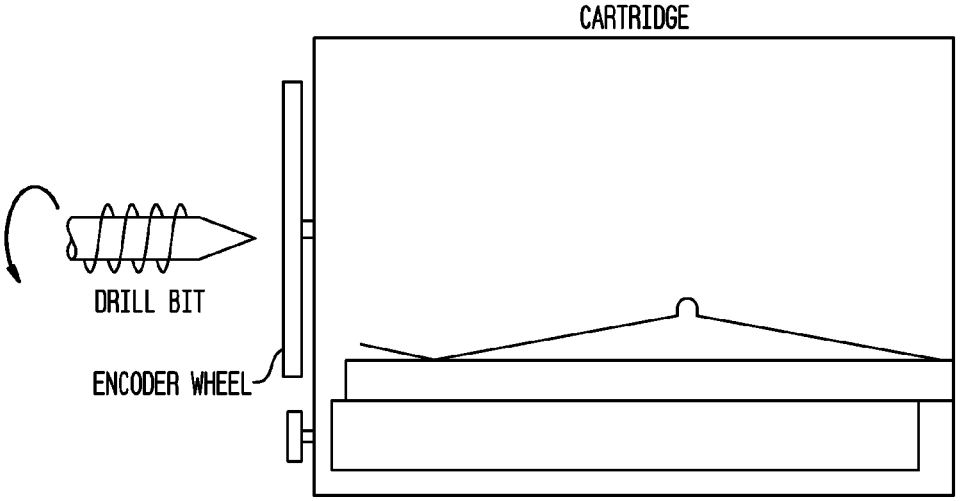
FIG. 17 illustrates and embodiment where a mechanism is used to remove the encoder wheel from the axle.

FIG. 17 illustrates and embodiment where a mechanism is used to remove the encoder wheel from the axle. When it is determined to disable the encoder wheel, a drill bit emerges from the printer. The drill bit is used to drill a hole in the center of the encoder wheel which causes the encoder wheel to separate from the drive shaft or axle.

Figure 18:
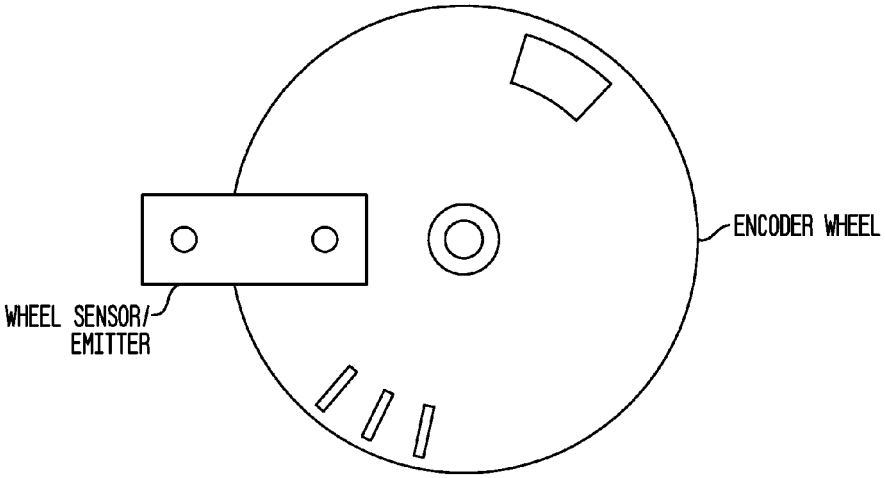
FIG. 18 illustrates an embodiment where a laser is used to damage the encoder wheel.

FIG. 18 illustrates an embodiment where a laser is used to damage the encoder wheel. When it is determined to disable the encoder wheel, the laser (or light source) used to read the encoder wheel is operated at an increased intensity level. The increased energy damages the slots in the encoder wheel preventing the encoder wheel from being used. In encoder wheels having a reflective material, the increased energy may damage the surface of the reflective material making the material non-reflective or may cause the adhesive to loosen.

Figure 19:
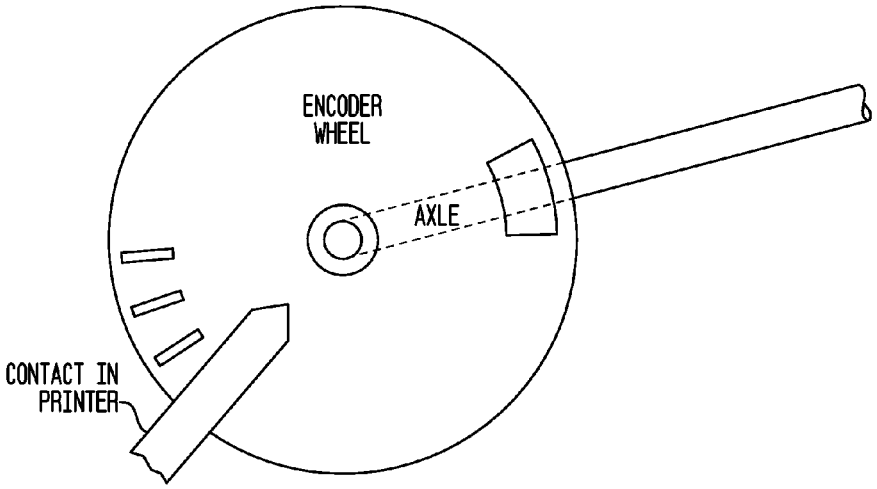
FIG. 19 illustrates an embodiment where the encoder wheel is fused to the axle.

FIG. 19 illustrates an embodiment where the encoder wheel is fused to the axle. When it is determined to disable the encoder wheel, a mechanism (or contact) extends from a surface in the printer to contact an interface between the encoder wheel and the axle. This contact results in the encoder wheel being fused to the axle. When the encoder wheel and the axle are fused together, the hopper cap is blocked by the encoder wheel with no clearance between them to remove the hopper cap. Thus, in order to refill the cartridge with toner a user must damage the encoder wheel.

It may desirable to disable or destroy another part of the printer or cartridge that results in a disabled encoder wheel. This may include but is not limited to: destroying or disabling the agitator axle; removing, destroying, or disabling one or more clips; removing destroying, disabling one or more clamps; and adding one or more mechanisms to the printer to cause encoder wheel failure.

Figure 20:
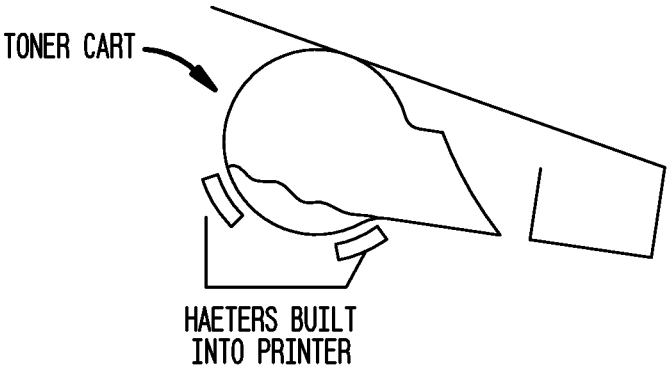
FIG. 20 illustrates an embodiment where heat is used to fuse toner in the cartridge.

FIG. 20 illustrates an embodiment where heat is used to fuse toner in the cartridge. In this embodiment, a heat-source generator is located inside of the printer and this heat-source generator is used to heat the toner remaining inside of the cartridge until the toner is fused into a solid. The agitator paddle, which is located within the cartridge, is fused into the toner and can no longer rotate. The encoder wheel is attached to the agitator axle and can no longer rotate. Alternatively, the agitator paddle is not fused within the toner, but, is unable to move the solid toner mass and is prevented from rotating.

Figure 21:
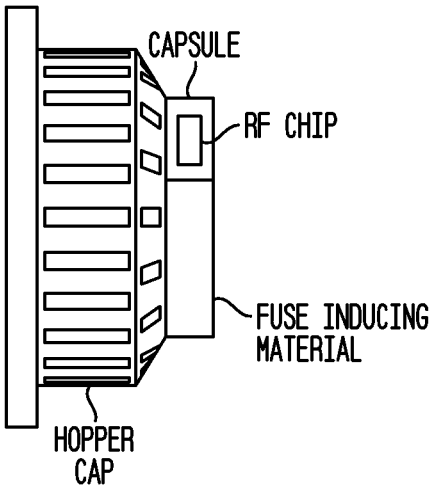
FIG. 21 illustrates an embodiment having a chip used to disable the encoder wheel or the cartridge.

FIG. 21 illustrates an embodiment having a chip used to disable the encoder wheel or the cartridge. This embodiment is similar to the embodiment described with FIG. 20 in that a material is released into the toner causing the toner to fuse into a solid mass. In this embodiment, a radio frequency transmitter is used to send a signal to the chip inside a capsule, located on the hopper. The chip can be located on the hopper cap or inside the cartridge. When the chip receives a signal, the chip releases material that causes toner to fuse and trap the agitator, breaking the axle.

Figure 22:
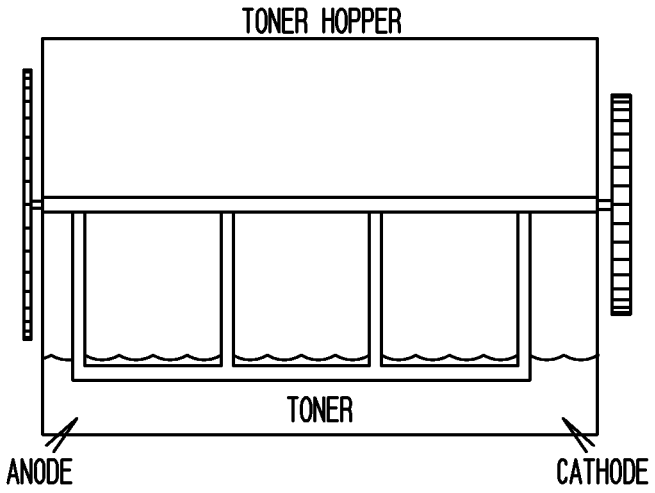
FIG. 22 illustrates another embodiment where the toner is fused into a solid mass.

FIG. 22 illustrates another embodiment where the toner is fused into a solid mass. In this embodiment, when it is desired to disable the encoder wheel or cartridge, the printer sends a current from the high voltage power supply into a high resistance contact, generating large amounts of energy and fusing the toner.

Figure 23:
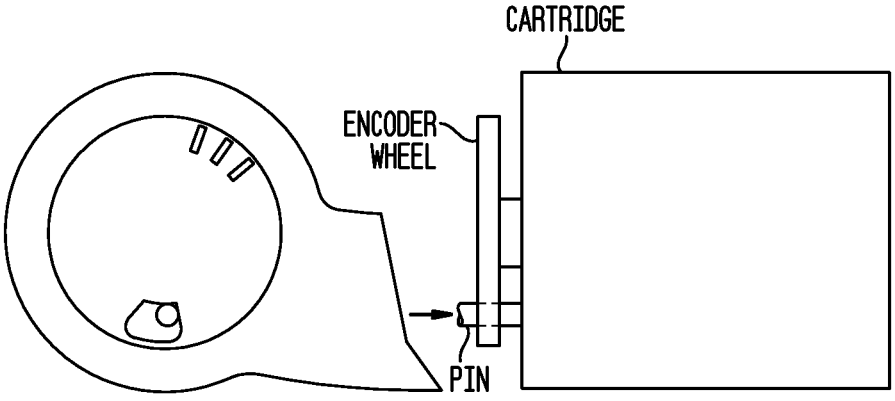
FIG. 23 illustrates an embodiment where a mechanism is used to prevent rotation of the encoder wheel.
Figure 24:
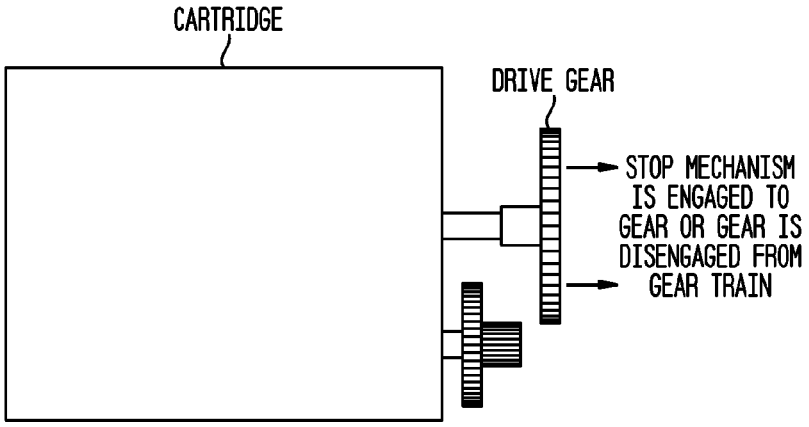
FIG. 24 illustrates an alternative embodiment where a mechanism is used to prevent rotation of a gear attached to the cartridge.

FIG. 23 illustrates an embodiment where a mechanism is used to prevent rotation of the encoder wheel. A mechanism, such as pin, engages the encoder wheel and prevents the encoder wheel from rotating. FIG. 24 illustrates an alternative embodiment. In this embodiment, the mechanism engages a part of the driving gear preventing the entire driving gear (including the encoder wheel) from rotating. This mechanism may interact with a gear on the opposite side of the toner cartridge.

Figure 25:
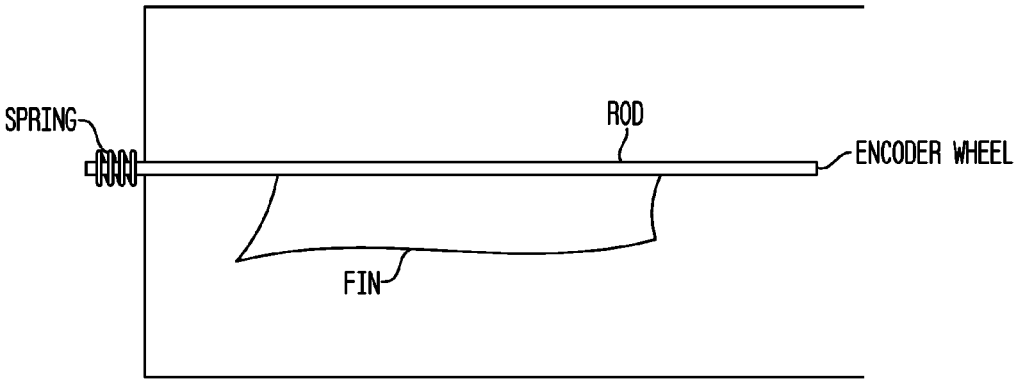
FIG. 25 illustrates an embodiment having a mechanism located within the cartridge prevents the agitator from rotating.
Figure 26:
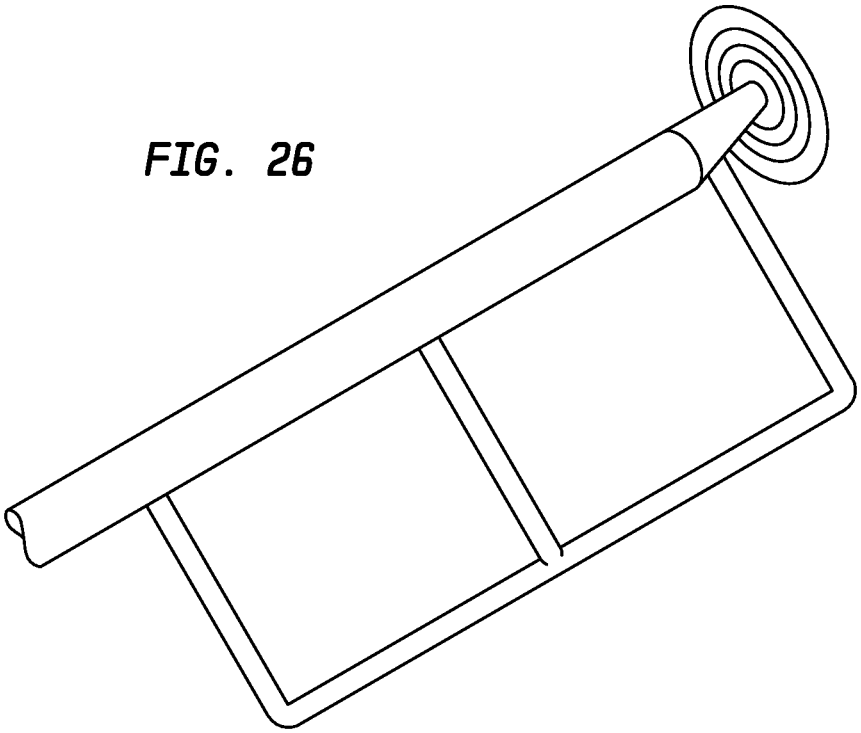
FIG. 26 illustrates an embodiment having a spring located within the cartridge.

Alternatively, a mechanism may be located inside the cartridge's toner hopper and engage the agitator and agitator shaft to stop rotation of the agitator. This embodiment is illustrated in FIG. 25 and FIG. 26. FIG. 25 shows a stop mechanism, such as a brake or spring, installed inside the cartridge and located between the agitator drive gear and the wall of the cartridge. The stopping mechanism may be attached at one end to the drive gear to provide the braking motion, causing the agitator axle to be stopped at the desired time. In order to reuse the cartridge, the stop mechanism must be reset or replaced. FIG. 26 shows an embodiment where the stop mechanism is a spring. The spring is located inside the cartridge and engaged with the agitator axle. As the agitator rotates, the spring force increases, eventually to a level that is so large that the spring force breaks the agitator axle. Alternatively, the spring force may increase to a level that prevents the agitator from rotating without causing the agitator axle to break.

In another embodiment, the printer disables the encoder wheel electronically. In printers, many replaceable devices have one or more chips located on the device. The chips are loaded with one or more memory areas that are read by the printer. In many printers the chip contains a code that identifies the replaceable device. In this embodiment, the printer could read the code that is associated with encoder wheel, the cartridge that the encoder wheel is attached to, or the reading unit associated with the encoder unit. At the desired time, the printer could record that the code is associated with a device that is no longer useable. This code could be sent to a database and read by all other printers. Therefore, the encoder wheel (and the associated cartridge) are then electronically tagged and cannot be used in printers. This embodiment has the advantage of allowing the manufacturer to recycle the cartridge and prevent unauthorized individuals from reusing the cartridge.

In another alternative embodiment, a fuse is located on the cartridge or a portion of the toner sensing system. At a predetermined time, a current is applied to the fuse, causing the fuse to blow. Once the fuse is blown, a detection system in the printer prevents the cartridge from being used. In order to reuse the cartridge, the fuse must be replaced. The fuse can be located on the encoder wheel, the cartridge, or any element associated with the cartridge.

Figure 27:
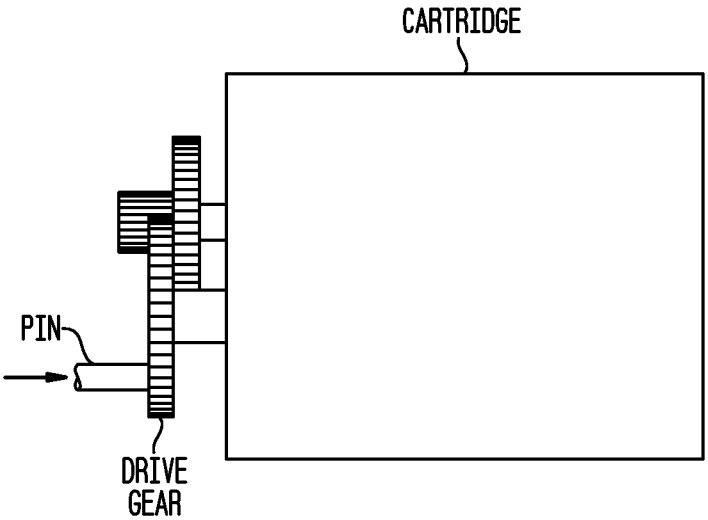
FIG. 27 illustrates an embodiment where the encoder wheel is disabled by damaging a wheel on the opposite side of the cartridge.

FIG. 27 illustrates an embodiment where the encoder wheel is disabled by damaging a drive wheel on the opposite side of the cartridge. The drive wheel is located on the opposite side of the cartridge from the encoder wheel but is attached to the encoder via the agitator shaft. The drive wheel rotates with the encoder wheel to rotate the gears on the drive side of the cartridge. If the drive wheel is damaged or disabled, the gears are disengaged and the encoder wheel will not rotate. The drive wheel may be damaged by any of the disclosed methods for damaging the encoder wheel.

Figure 28:
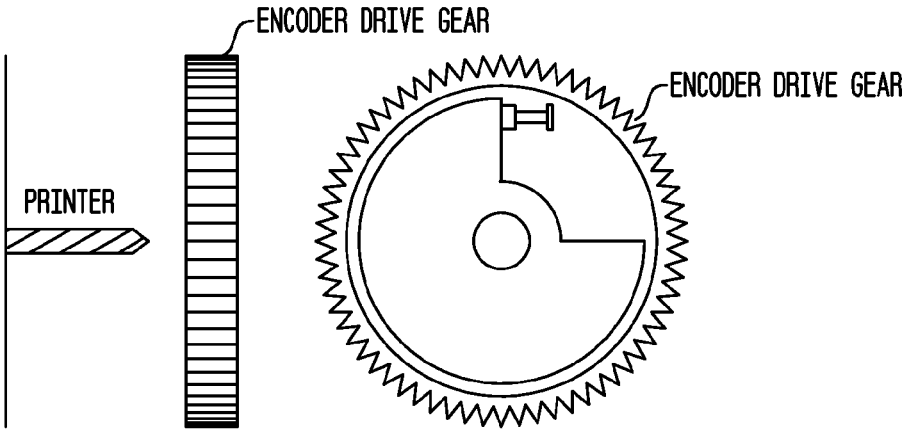
FIG. 28 illustrates a mechanism for damaging the drive gear.

FIG. 28 illustrates a mechanism that is used to damage the drive wheel. When it is desired to disable the encoder, a drill bit fixture within the printer or cartridge will drill out the spot weld in the middle of the encoder drive gear, damaging the gear, and disabling the agitator wheel.

Figure 29:
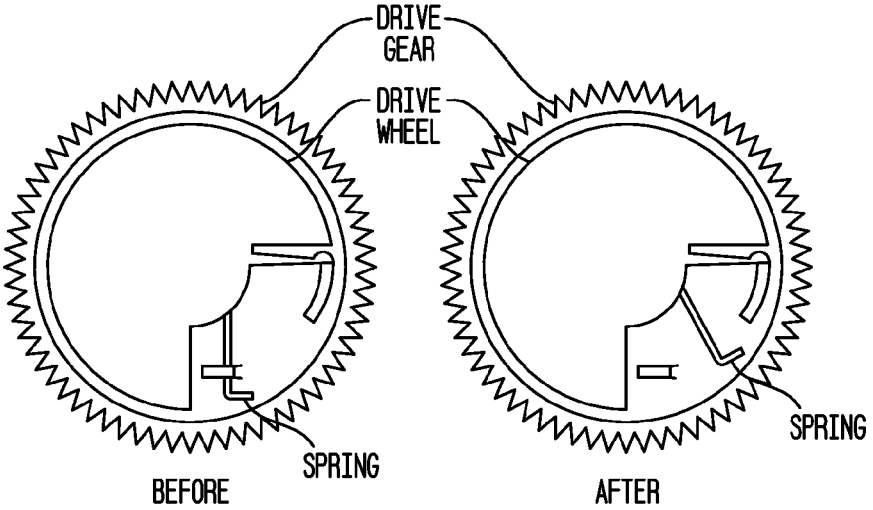
FIG. 29 illustrates an embodiment where the drive wheel is connected to the drive gear with a torsion spring.

As described above, the drive wheel is located on the opposite side of the cartridge from the encoder wheel but is attached via the agitator shaft. FIG. 29 illustrates an embodiment where the drive wheel is connected to the drive gear with a torsion spring. By utilizing a means to dislodge, disconnect, or separate the spring from its latches, the drive gear is disabled and does not transmit the rotation of the gears to the encoder wheel through the agitator shaft and drive wheel. This will stop the encoder wheel from rotation without damaging the wheel but will require a replacement or resetting to occur prior to making the remanufactured cartridge function.

Figure 30:
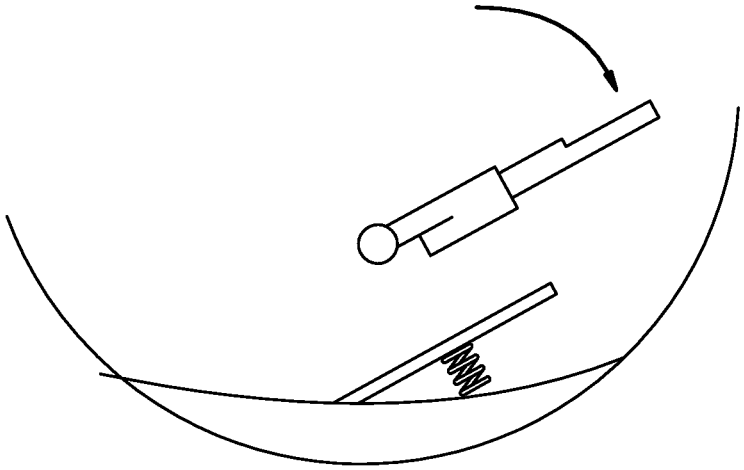
FIG. 30 illustrates an embodiment where a spring-loaded plate is located inside the cartridge.

FIG. 30 illustrates an embodiment where a spring-loaded plate is located inside the cartridge. Toner used in the electrophotographic process is relatively dense. When the cartridge is initially filled with toner, the weight of the toner holds the spring-loaded plate down. As toner is used during printing, the weight of the toner decreases and the spring-loaded plate starts to lift up. Eventually, when enough toner is used, the spring-loaded plate rises enough that the plate interferes with the rotation of the toner agitator paddle. In order to reuse the cartridge the spring-loaded plate must be properly reloaded.

Figure 31:
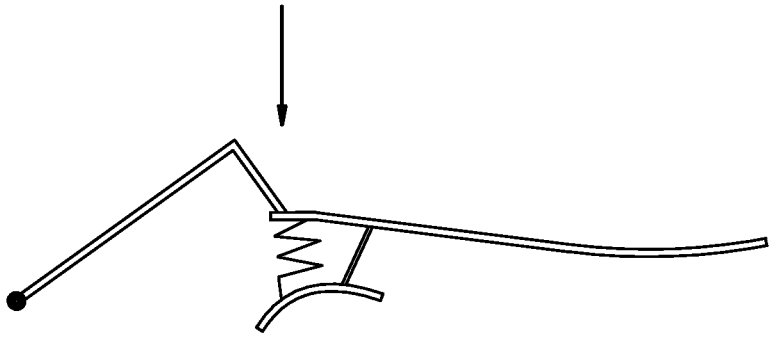
FIG. 31 illustrates an embodiment where a spring-loaded stopping mechanism is located within the cartridge.

FIG. 31 illustrates an embodiment where a spring-loaded latching mechanism is located within the cartridge. A latching device is utilized as a spring-loaded stopping mechanism. As the toner is used in the cartridge, the agitator starts to compress the spring. When the toner is reduced to a small enough level, the agitator completely compresses the spring and locks onto a brace. This prevents the agitator from rotating. Consequently, the encoder wheel is unable to rotate.

Figure 32:
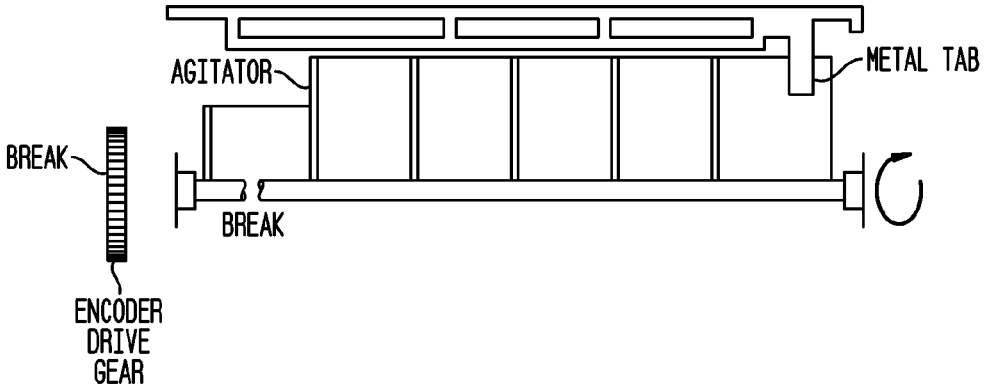
FIG. 32 illustrates an embodiment where the gear is driven in a reverse direction.

FIG. 32 illustrates another embodiment where the printer can operate the drive gear in a reverse direction. When the gear is operated in the reverse direction, the agitator (and other parts) rotates backwards. The agitator rotates backwards until it contacts a metal tab on the flap that moves toner towards the adder roller. This contact between the agitator and the metal flap will eventually cause the agitator to break. The broken agitator will prevent the cartridge from being reused or refilled. Alternatively, this backwards rotation causes stress on the parts and material because the parts were designed to be rotated in only a forward direction. This stress causes damage to the system and prevents the parts from being reused or remanufactured.

Figure 33:
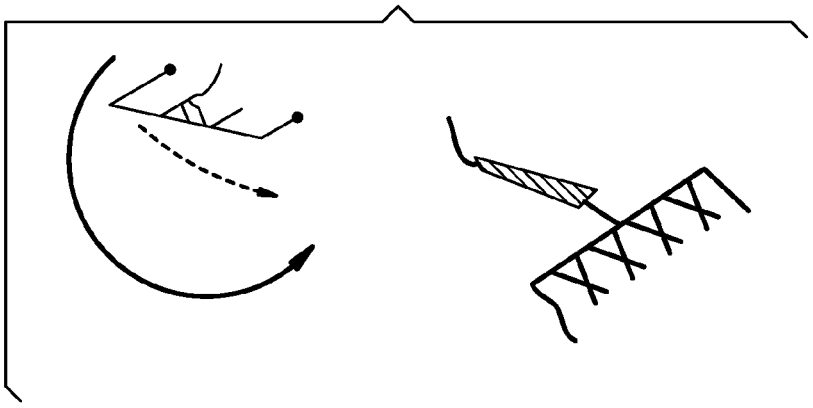
FIG. 33 illustrates an embodiment using a "dead man's switch"

FIG. 33 illustrates an embodiment using a "dead man's switch." A dead man's switch is a switch that is held down in some manner. Releasing the switch causes the device to be deactivated (or activated). A "dead man's switch" is installed inside the cartridge and attached to the agitator assembly. The switch is held down in some manner, such as a ribbon. At the desired time, a signal is sent and the mechanism holding down the switch is removed. The switch is released completing a signal that prevents the cartridge from being reused. Alternatively, the switch may be closed by using adhesive. At the desired time the adhesive is melted (via heat or light source) and the switch is activated.

Figure 34:
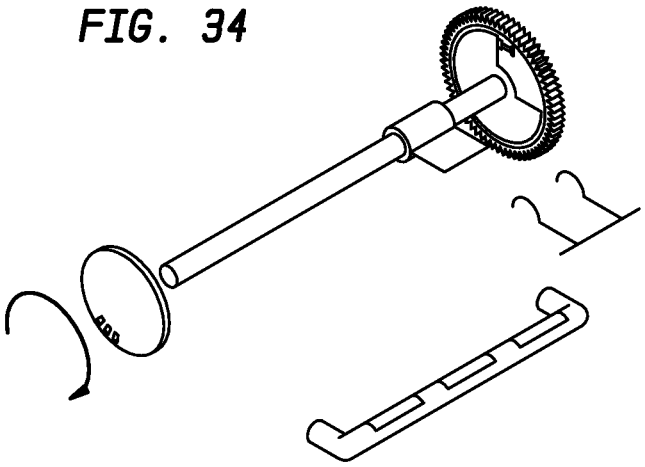
FIG. 34 illustrates an embodiment for disabling a lever located in the agitation section of the cartridge.

In some printers, a lever is located in the agitation section of the cartridge. The lever is used to help maintain pressure in the system and to assist in accurate toner sensing. FIG. 34 illustrates an embodiment for disabling the lever. When it is desired to disable the encoder wheel or cartridge, this lever is dislodged and the encoder wheel is unable to put tension on the agitator and therefore the encoder wheel can rotate freely. Because the encoder wheel spins freely it cannot be used to sense the toner levels properly, and cannot be used again without outside intervention. The lever may be disengaged by any suitable method including the methods described herein.

Figure 35:
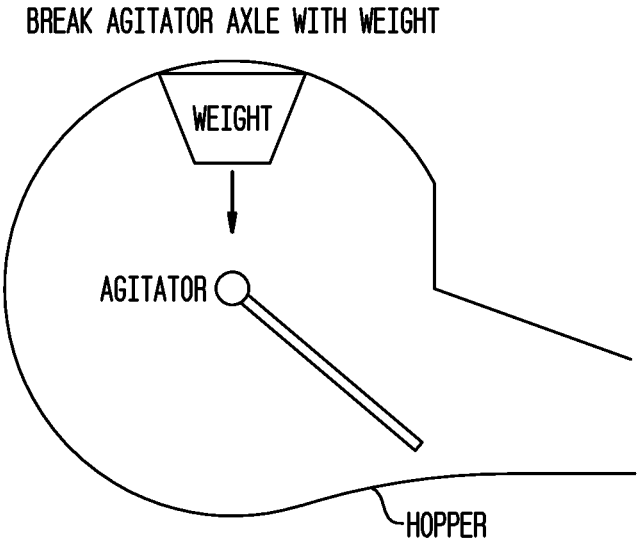
FIG. 35 illustrates an embodiment having a weight located within the cartridge.

FIG. 35 illustrates an embodiment having a weight located within the cartridge. In this embodiment, when it is desired to disable the encoder wheel or cartridge, the weight is dropped inside of the hopper and breaks the agitator axle. The broken agitator axle prevents the encoder wheel from rotating and makes the cartridge non useable. The weight can be spring loaded or installed under pressure so as to generate enough momentum to snap the axle at a short dropping distance. The weight can be released by melting an adhesive or any other known and desirable method.

Figure 36:
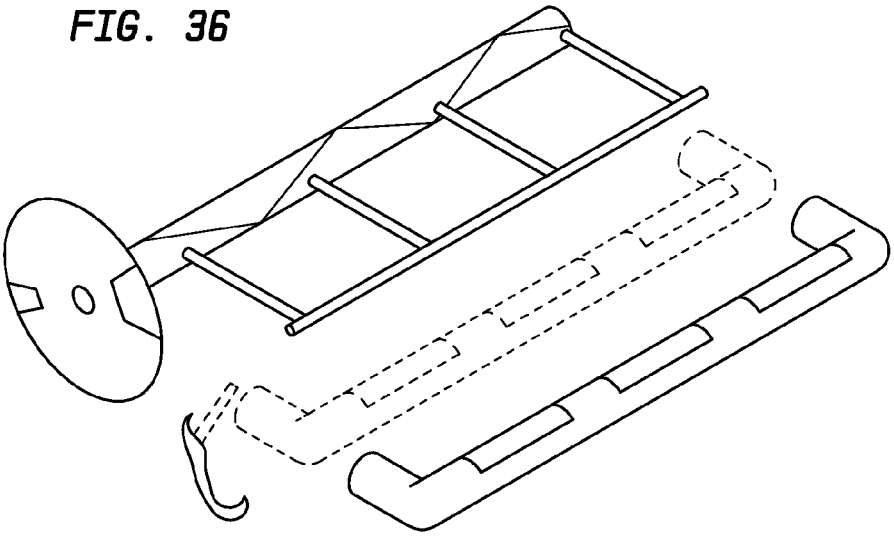
FIG. 36 illustrates an embodiment for printers that do not have a lever arm attached to the agitator axle.

FIG. 36 illustrates an embodiment for printers that do not have a lever arm attached to the agitator axle. In this type of printer there is typically a paper clip-style clamp connected to a metal sealing fixture near the adder roller. If this clamp is loosened or dislodges the metal sealing blade, then the agitator axle can rotate freely, thus disabling the effectiveness of the encoder wheel. This clamp can be loosened or removed by any known method including the methods disclosed herein.

Figure 37:
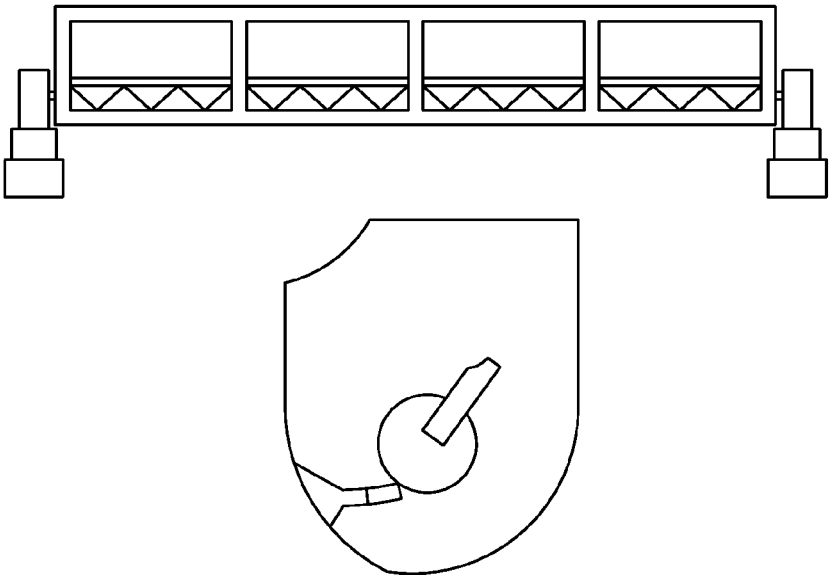
FIG. 37 illustrates an embodiment having a high-friction material located inside the cartridge.

FIG. 37 illustrates an embodiment having a high-friction material located inside the cartridge. Toner is used in the electrophotographic process in many ways, including as a lubricant. A piece of high-friction material, such as a urethane rubber, could be set against the agitator axle or the agitator axle bearing(s). When there is a large amount of toner in the system, the toner acts as a lubricant between the high-friction material and the rotating member. Thus, the agitator can rotate against the high-friction material without being damaged. As the toner is depleted, there is less toner to act as a lubricant and friction increases between the high-friction material and the agitator. Eventually, the friction is so great that it prevents the agitator from rotating properly. Alternatively, the friction may damage the agitator before the agitator is prevented from rotating freely.

In some printers, the encoder wheel mechanism may not be located on the cartridge. In these printers, the encoder wheel is mounted on an inside of the printer. In these printers, the encoder wheel can be designated by the printer to work only under certain parameters. This in turn forces the end user to use only certain types of cartridges. Alternatively, this could enable the manufacturer to make the printer into a disposable unit.

The many features and advantages of the invention are apparent from the detailed specification. Thus, the appended claims are intended to cover all such features and advantages of the invention which fall within the true spirits and scope of the invention. Further, since numerous modifications and variations will readily occur to those skilled in the art, it is not desired to limit the invention to the exact construction and operation illustrated and described. Accordingly, all appropriate modifications and equivalents may be included within the scope of the invention.

Although this invention has been illustrated by reference to specific embodiments, it will be apparent to those skilled in the art that various changes and modifications may be made which clearly fall within the scope of the invention. The invention is intended to be protected broadly within the spirit and scope of the appended claims.

What is claimed is:

1. An image recording device comprising:

a cartridge containing a recording medium therein, wherein the recording medium is toner;

an encoder wheel attached to the cartridge, wherein the encoder wheel is configured to convey information to the image recording device about at least one of an amount of toner currently contained within the cartridge and a cartridge characteristic; and a device configured to physically disable the encoder wheel so that the encoder wheel cannot convey the information to the image recording device, wherein the device configured to physically disable the encoder wheel is a cutting device.

2. The image recording device of claim 1, wherein the cutting device is at least one of a pin or a blade.

3. A method for disabling an encoder wheel in an image recording device comprising:

providing a cartridge containing a recording medium therein, wherein the recording medium is toner;

providing an encoder wheel attached to the cartridge, wherein the encoder wheel is configured to convey information to the image recording device about at least one of an amount of toner currently contained within the cartridge and a cartridge characteristic;

determining that it is desirable to disable the encoder wheel attached to the cartridge; and physically disabling the encoder wheel so that the encoder wheel cannot convey the information to the image recording device, wherein the encoder wheel is disabled by cutting.

4. A method for disabling an encoder wheel in an image recording device comprising:

providing a cartridge containing a recording medium therein, wherein the recording medium is toner;

providing an encoder wheel attached to the cartridge, wherein the encoder wheel is configured to convey information to the image recording device about at least one of an amount of toner currently contained within the cartridge and a cartridge characteristic;

determining that it is desirable to disable the encoder wheel attached to the cartridge; and physically disabling the encoder wheel so that the encoder wheel cannot convey the information to the image recording device wherein the step of physically disabling the encoder wheel permanently destroys the encoder wheel.

* * * * *